US006871659B2

(12) United States Patent
Tung

(10) Patent No.: US 6,871,659 B2
(45) Date of Patent: Mar. 29, 2005

(54) TELESCOPIC SUNSHADE

(76) Inventor: Benson Tung, No. 587, Chien-Gong Road, San Min, Kaohsiung (TW)

( * ) Notice: Subject to any disclaimer, the term of this patent is extended or adjusted under 35 U.S.C. 154(b) by 0 days.

(21) Appl. No.: 10/444,840

(22) Filed: May 23, 2003

(65) Prior Publication Data

US 2004/0231712 A1 Nov. 25, 2004

(51) Int. Cl.[7] ..... A45B 17/00
(52) U.S. Cl. ..... 135/20.3
(58) Field of Search ..... 135/15.1, 20.3, 135/25.1, 25.4, 19, 21, 20.1, 98, 99

(56) References Cited

U.S. PATENT DOCUMENTS

| | | | | |
|---|---|---|---|---|
| 534,058 A | * | 2/1895 | Ackermann | 135/98 |
| 1,616,276 A | * | 2/1927 | Orsik | 135/20.3 |
| 3,926,202 A | * | 12/1975 | Uthemann et al. | 135/20.3 |
| 4,132,236 A | * | 1/1979 | Petersen et al. | 135/16 |
| 4,674,522 A | * | 6/1987 | Ma | 135/20.3 |
| 6,230,724 B1 | * | 5/2001 | Lai | 135/20.3 |

FOREIGN PATENT DOCUMENTS

| | | | | |
|---|---|---|---|---|
| DE | 2300472 | * | 7/1974 | 135/20.3 |
| DE | 3113994 | * | 10/1982 | |
| EP | 392989 | * | 10/1990 | 135/20.3 |
| GB | 1357870 | * | 6/1974 | 135/20.3 |

* cited by examiner

*Primary Examiner*—James O. Hansen
(74) *Attorney, Agent, or Firm*—Alan D. Kamrath; Nikolai & Mersereau, P.A.

(57) ABSTRACT

A sunshade includes a post including an upper tube and a lower tube, one of which is telescopically received in the other. One of the upper tube and the lower tube has a cord hole through which a lower end of a cord extends to outside of the post. A reel includes a handle having a shaft formed on an end thereof. The shaft is rotatably supported by the post yet allows relative telescopic movement between the upper tube and the lower tube. The shaft has a portion outside the post, with the lower end of the cord being attached to the portion of the shaft. The lower end of the cord is wound around the portion of the shaft when the cord is moved in a retracting direction.

20 Claims, 9 Drawing Sheets

TELESCOPIC SUNSHADE

BACKGROUND OF THE INVENTION

1. Field of the Invention

The present invention relates to a telescopic sunshade. In particular, the present invention relates to a sunshade including a post having an upper tube and a lower tube, one of which is telescopically received in the other.

2. Description of the Related Art

A sunshade is almost a necessity for shielding rain and sun for outdoor activities. A reel is generally used for folding/unfolding the sunshade to save labor. FIGS. 1 and 2 illustrate a typical sunshade including a post 11, a base 12 attached to a lower end of the post 11, and a reel 13 with a handle 131. Upon turning of the handle 131, the stretchers 14 and the ribs 15 are moved thereby folding/unfolding a canopy 16. The post 11 includes an upper tube 111 on which the reel 13 is mounted and a lower tube 112. The reel 13 is comprised of two casing halves 132 securely mounted around the upper tube 111, with a shaft 133 rotatably extending through the upper tube 111. A lower end of a cord 134 inside the post 11 is wound around the shaft 133, with an upper end of the cord 134 being attached to a mechanism (not shown) for moving the stretchers 14 and the ribs 15. Thus, the cord 134 is moved in a releasing direction or retracting direction to fold or unfold the sunshade. However, the upper tube 111 and the lower tube 112 are not telescopic, as the shalt 133 extends through the upper tube 111. Thus, the upper tube 111 and the lower tube 112 must be stored separately when not in use, occupying considerable space for storage and transport while risking loss of the tubes 111 and 112. Further, reassembly of the sunshade is laborsome and time-consuming.

SUMMARY OF THE INVENTION

An object of the present invention is to provide a sunshade including a post having an upper tube and a lower tube, one of which is telescopically received in the other.

A sunshade in accordance with the present invention includes:

a post including an upper tube and a lower tube, one of which is telescopically received in the other, one of the upper tube and the lower tube having a cord hole through which a lower end of a cord extends to an outside of the post;

a reel including a handle, a shaft being formed on an end of the handle, the shaft being rotatably supported by the post yet allowing relative telescopic movement between the upper tube and the lower tube, the shaft having a portion outside the post, with the lower end of the cord being attached to the portion of the shaft, the lower end of the cord being wound around the portion of the shaft when the cord is moved in a retracting direction; and means for selectively retaining the upper tube and the lower tube in an extended state and allowing the relative telescopic movement between the upper tube and the lower tube.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
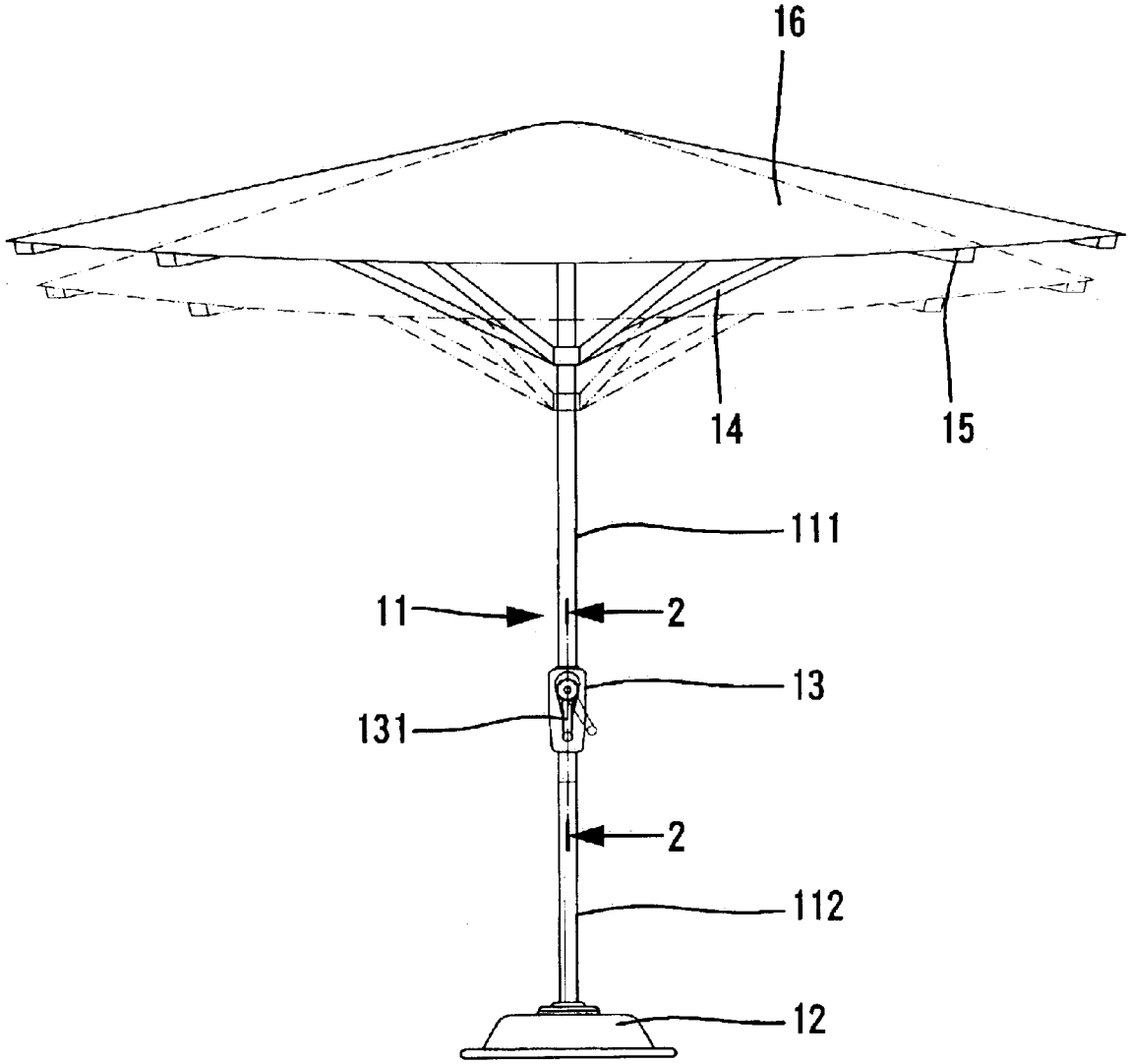
FIG. 1 PRIOR ART
FIG. 1 is a schematic side view of a conventional sunshade.
Figure 2:
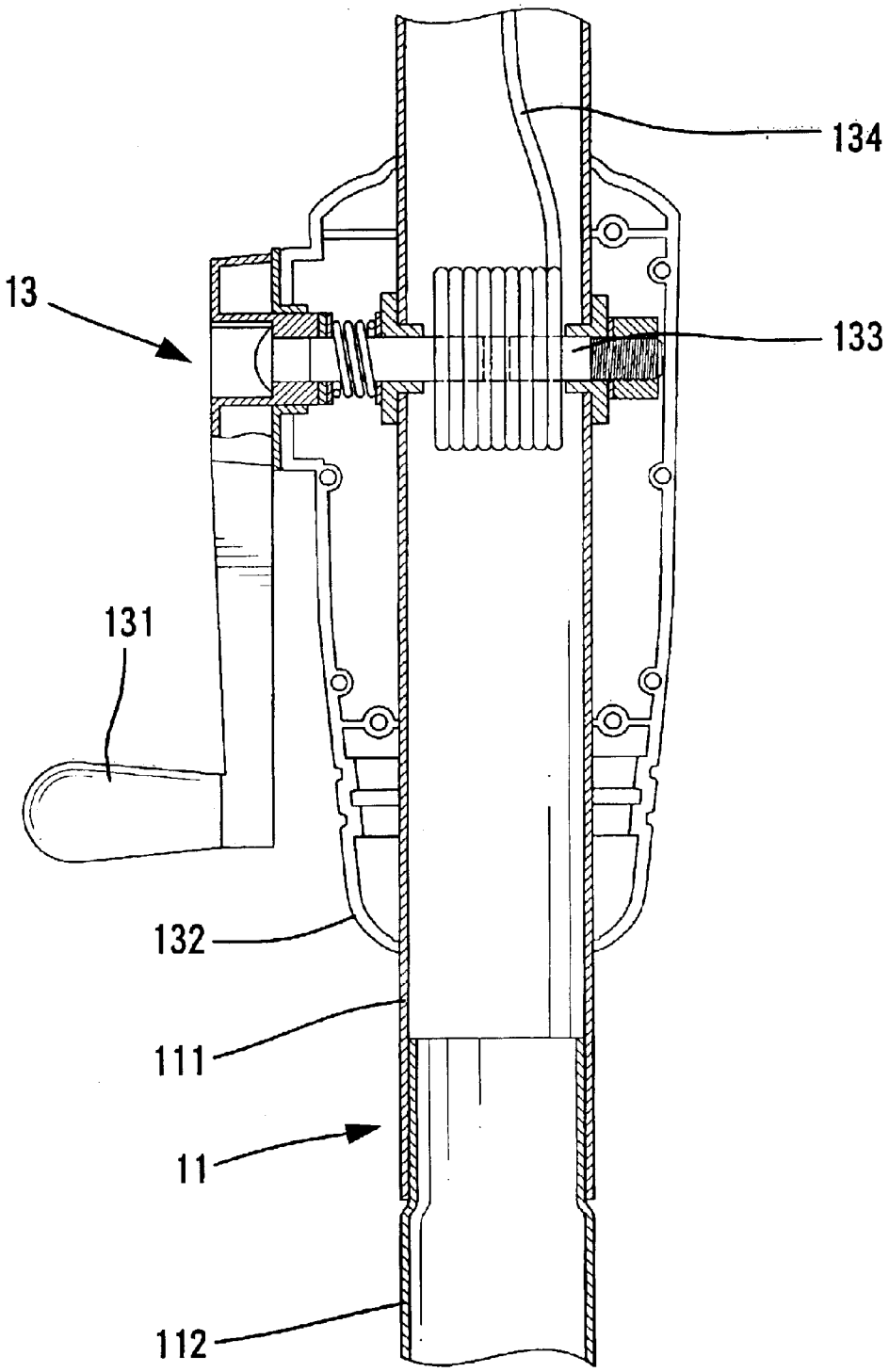
FIG. 2 PRIOR ART
FIG. 2 is a sectional view taken along line 2—2 in FIG. 1.
Figure 3:
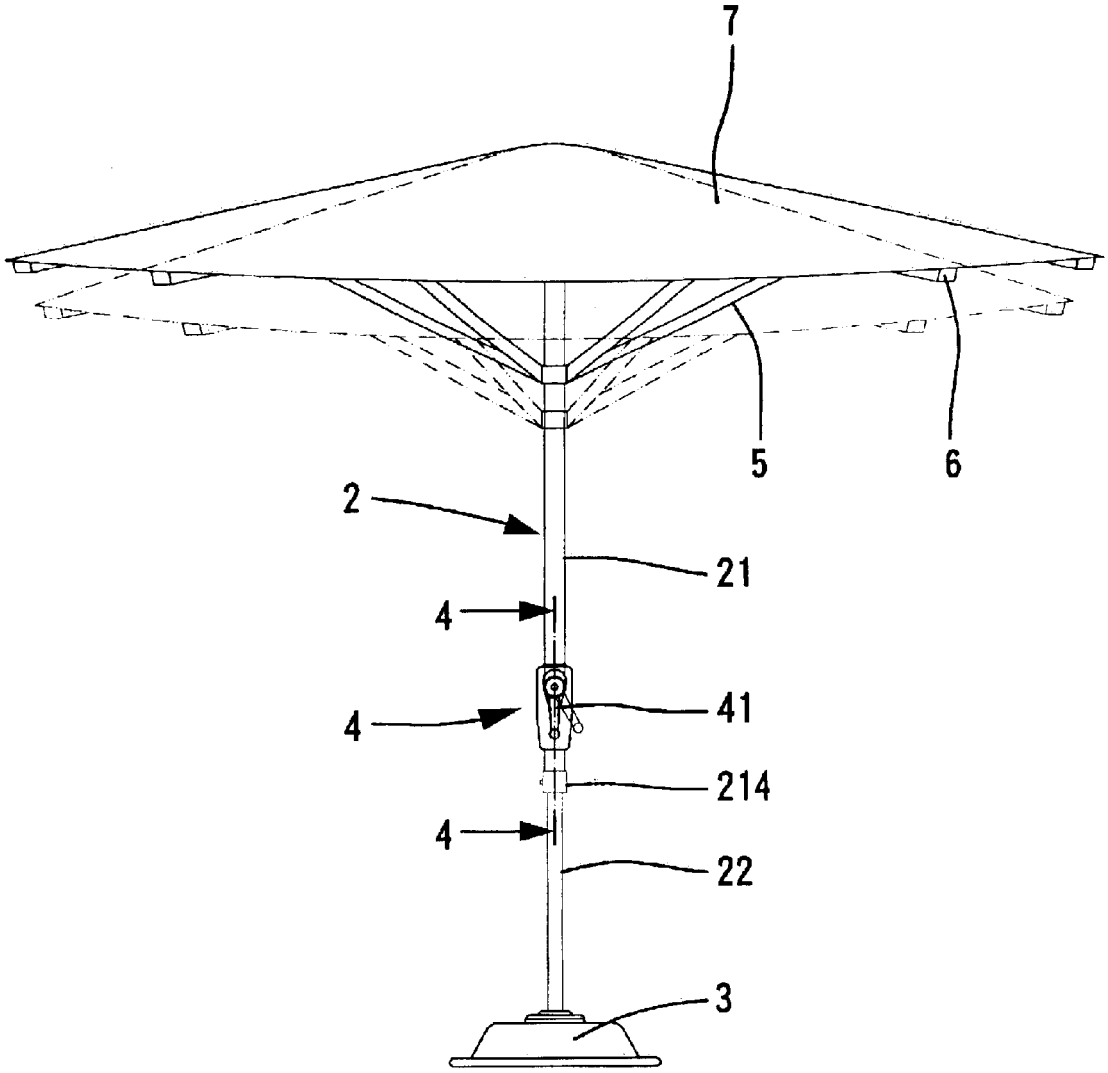
FIG. 3 is a schematic side view of a sunshade in accordance with the present invention.
Figure 4:
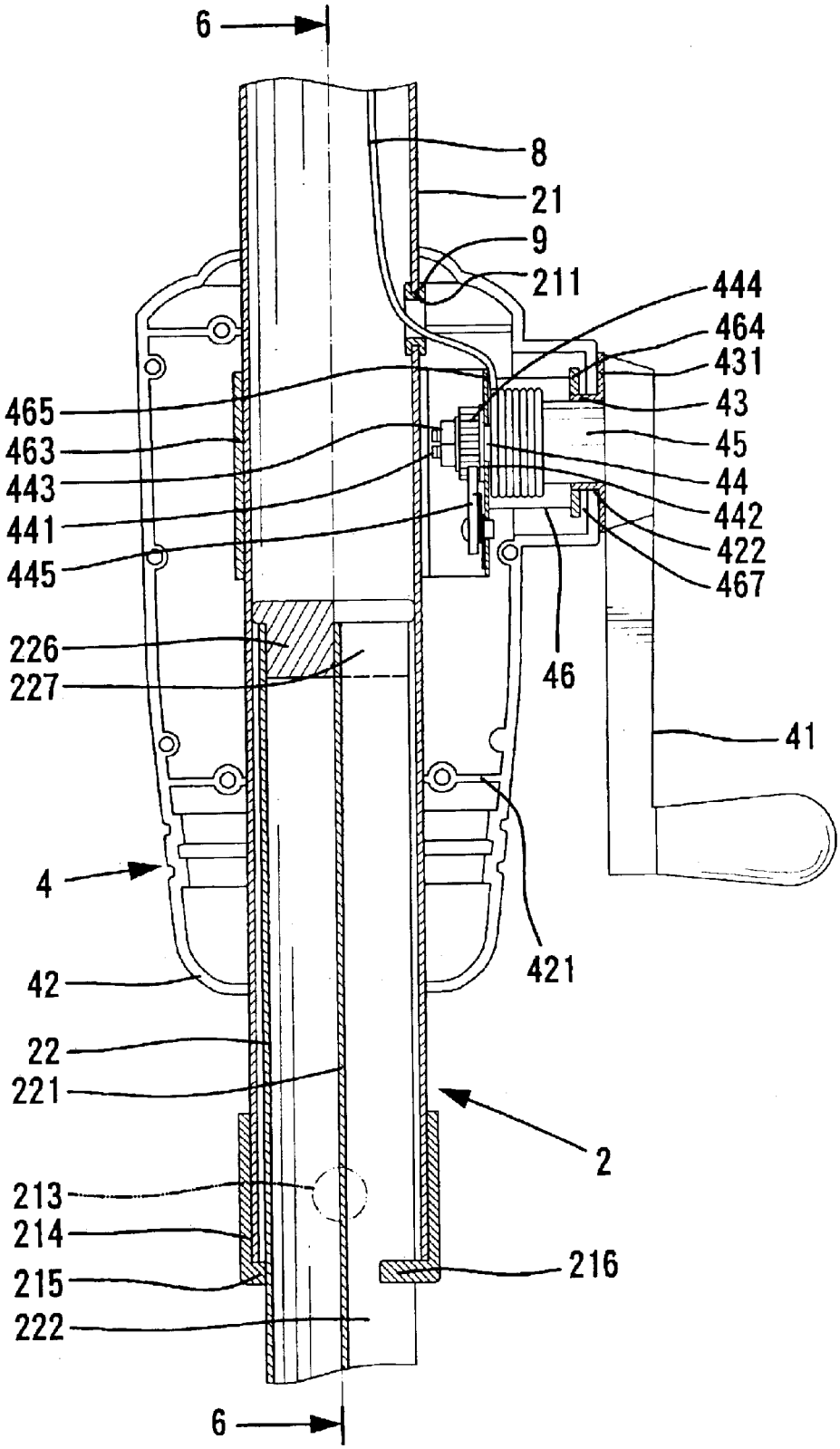
FIG. 4 is a sectional view taken along line 4—4 in FIG. 3.

Referring to FIGS. 3 and 4, a sunshade in accordance with the present invention generally comprises a post 2 including at least two telescopic tubes. In this embodiment, the post 2 includes an upper tube 21 and a lower tube 22 having a lower end to which a base 3 mounted. A canopy 7 is mounted above the upper tube 21 and foldable/unfoldable by a plurality of stretchers 5 and ribs 6 via a mechanism (not shown) to which an upper end of a cord 8 is attached. A reel 4 is mounted to the post 2 and includes a handle 41 to which a lower end of the cord 8 is attached. Thus, upon rotation of the handle 41, the canopy 7 is folded/unfolded.

Figure 5:
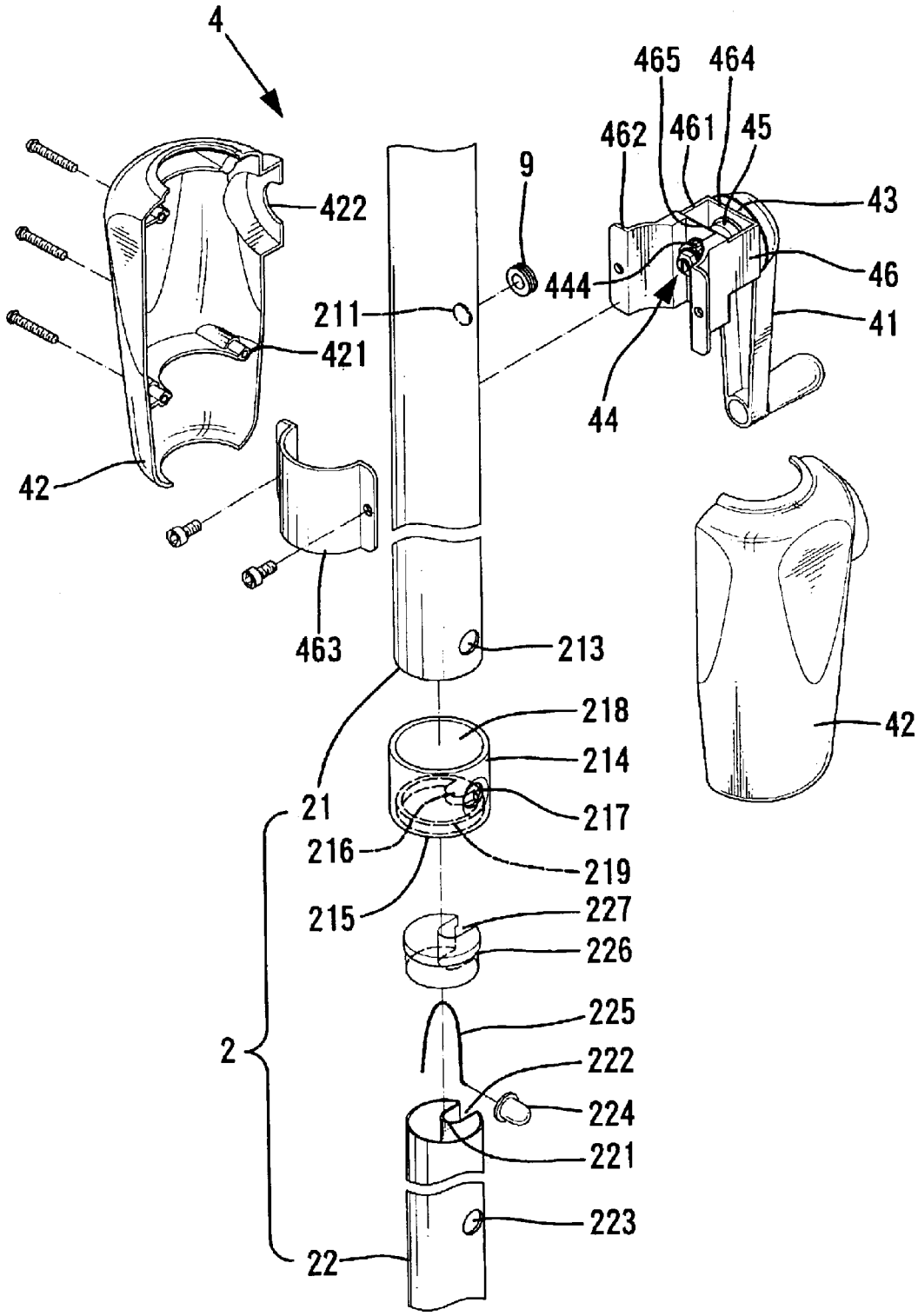
FIG. 5 is an exploded perspective view of a portion of the sunshade in accordance with the present invention.

Referring to FIGS. 4 and 5, the reel 4 includes the handle 41 and a casing comprised of two casing halves 42. Each casing half 42 includes an arcuate clamping portion 421 for clamping around the upper tube 21. After assembly, a through-hole 422 is formed in the casing halves 42 and extends in a radial direction.

Formed on an end of the handle 41 is a shaft 44 that extends through the through-hole 422 of the casing halves 42. An axle 45 is mounted around an outer portion of the shaft 44, allowing free rotation of the shaft 44 in the axle 45. As illustrated in FIG. 4, a jacket 43 is mounted between the axle 45 and a periphery delimiting the through-hole 422 of the casing halves 42. Also mounted around the axle 45 is a fixing seat 46 having a frame 461 with two arcuate clamping portions 462 extending from an inner end of the frame 461, thereby forming a semi-circular clamping section for embracing a peripheral portion of a section of an outer periphery of the upper tube 21. A semi-circular clamping plate 463 is mounted to the upper tube 21 and embraces another peripheral portion of the section of the outer periphery of the upper tube 21, and fasteners (not labeled) are extended through holes (not labeled) in the semi-circular clamping plate 463 and holes (not labeled) in the arcuate clamping portions 462, thereby securely fixing the fixing seat 46 and the axle 45 to the upper tube 21.

Figure 7:
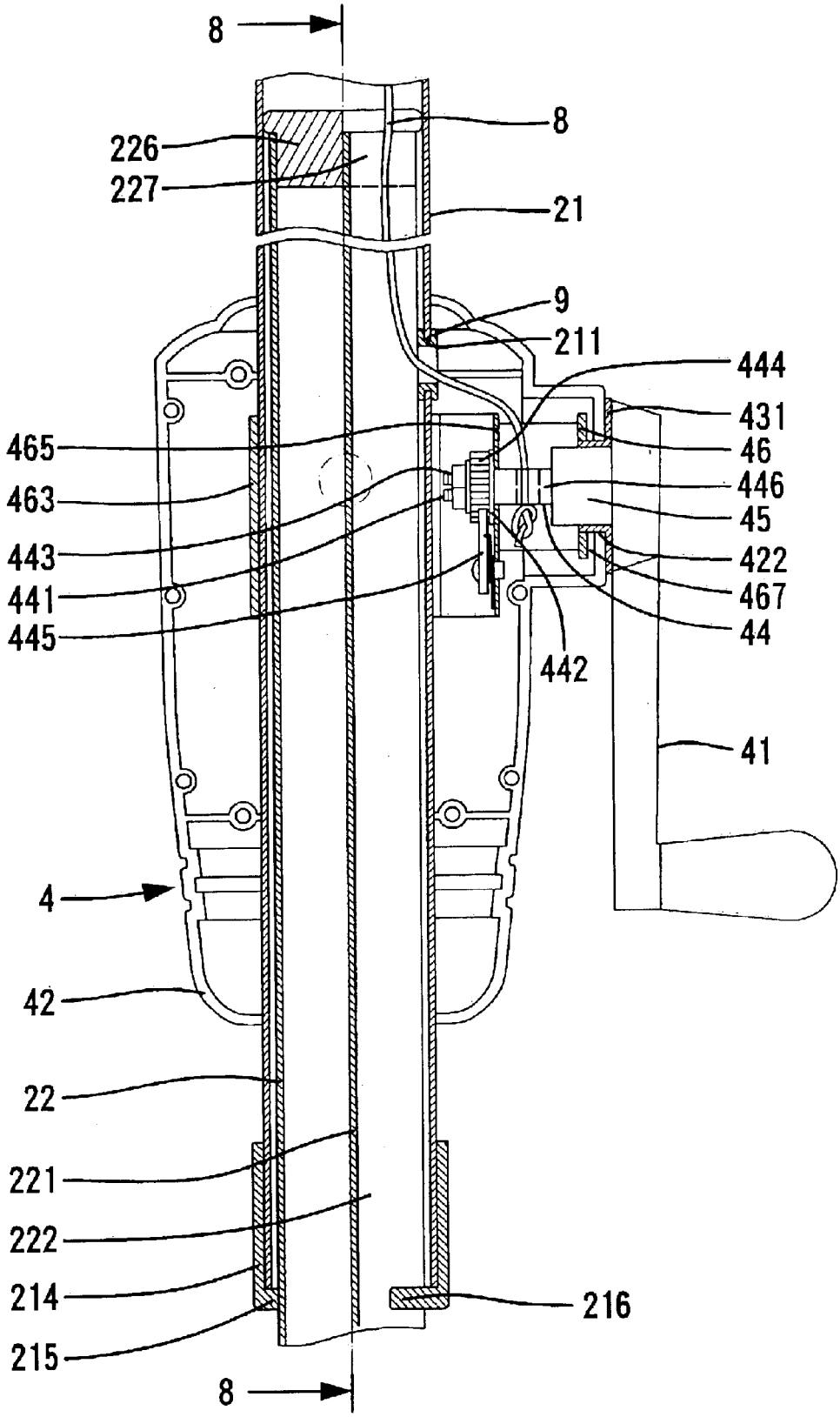
FIG. 7 is a view similar to FIG. 4, illustrating relative telescopic movement between a lower tube and an upper tube of a post of the sunshade.
Figure 8:
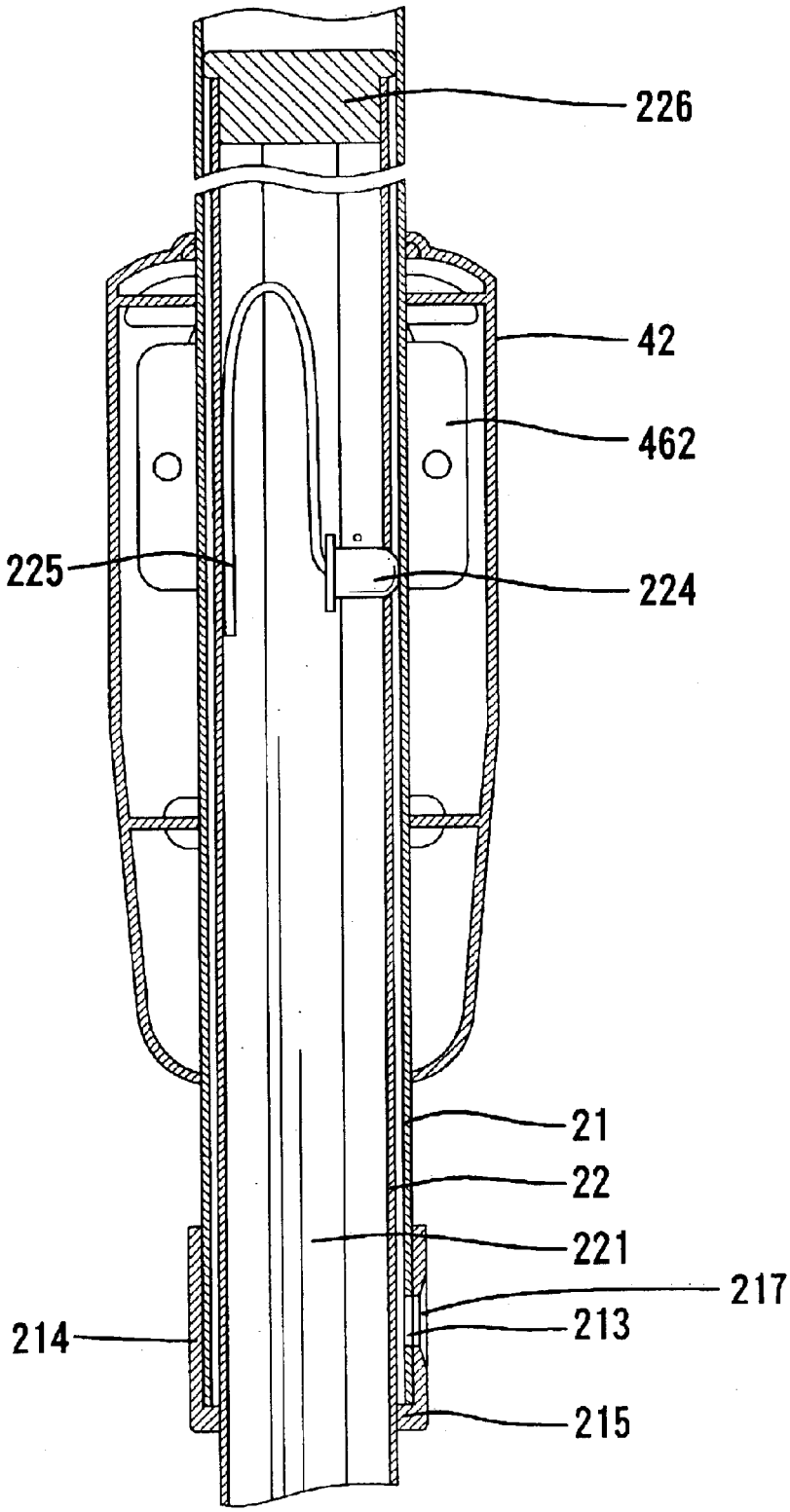
FIG. 8 is a sectional view taken along line 8—8 in FIG. 7.

Still referring to FIGS. 4 and 5, the frame 461 of the fixing seat 46 includes an outer wall 464 distal to the upper tube 21 and an inner wall 465 that is closer to the upper tube 21 than the outer wall 464. The periphery delimiting the through-hole 422 of the casing halves 42 is located in a receiving space 467 between the flange 431 of the jacket 43 and the outer wall 464 of the frame 461. The inner wall 465 has a hole (not labeled) through which an inner end 441 of the shaft 44 passes. Thus, an intermediate portion 446 (see FIG. 7) of the shaft 44 is located between the axle 45 and the inner wall 465 of the frame 461, and a lower end of the cord 8 is attached to the intermediate portion 446 of the shaft 44. When the handle 41 is turned, the cord 8 is wound around the intermediate portion 446 of the shaft 44 (FIG. 4) when the cord 8 is moved in the retracting direction. A ratchet wheel 444 is mounted to the inner end 441 of the shaft 44 and sandwiched between a washer 442 and a nut 443. A catch 445 is mounted to the inner wall 465 of the frame 461 and meshes with the ratchet wheel 444.

A positioning hole 213 is defined in a lower end of the upper tube 21. Located above the positioning hole 213 is a cord hole 211 through which the lower end of the cord 8 extends from an interior of the upper tube 21 to the intermediate portion 446 of the shaft 44, best shown in FIG. 4. To prevent damage to the cord 8, a rubber ring 9 is inserted into the cord hole 211 and has a hole (not labeled) through which the cord 8 extends.

In this embodiment, the lower tube 22 has a diameter slightly smaller than that of the upper tube 21. Thus, the lower tube 22 is telescopically received in the upper tube 21. A lower cap 214 is mounted to the lower end of the upper tube 21 and includes an end wall 215. The lower cap 214 further includes a longitudinal hole 218 extending through the end wall 215, with the remaining portion of the end wall 215 forming a stop 219. A guide member 216 extends from a peripheral wall of the stop 219, and a transverse hole 217 is defined in the lower cap 214 and aligned with the positioning hole 213 of the upper tube 21.

The lower tube 22 includes a recessed portion 221 extending along a longitudinal direction thereof, thereby forming a longitudinal groove 222 in an outer periphery thereof. The longitudinal groove 222 is wide enough to receive the cord 8 when the lower tube 22 is telescopically moved in the upper tube 21. The lower tube 22 further has a transverse positioning hole 223 in an upper end thereof. An upper cap 226 is mounted to a top of the lower tube 22 and has a longitudinal groove 227 aligned with the longitudinal groove 222 of the lower tube 22. The guide member 216 of the lower cap 214 mounted to the lower end of the upper tube 21 is guided in the longitudinal groove 222 of the lower tube 22, preventing undesired relative rotational movement between the upper tube 21 and the lower tube 22 while allowing relative longitudinal telescopic movement between the upper tube 21 and the lower tube 22.

Figure 6:
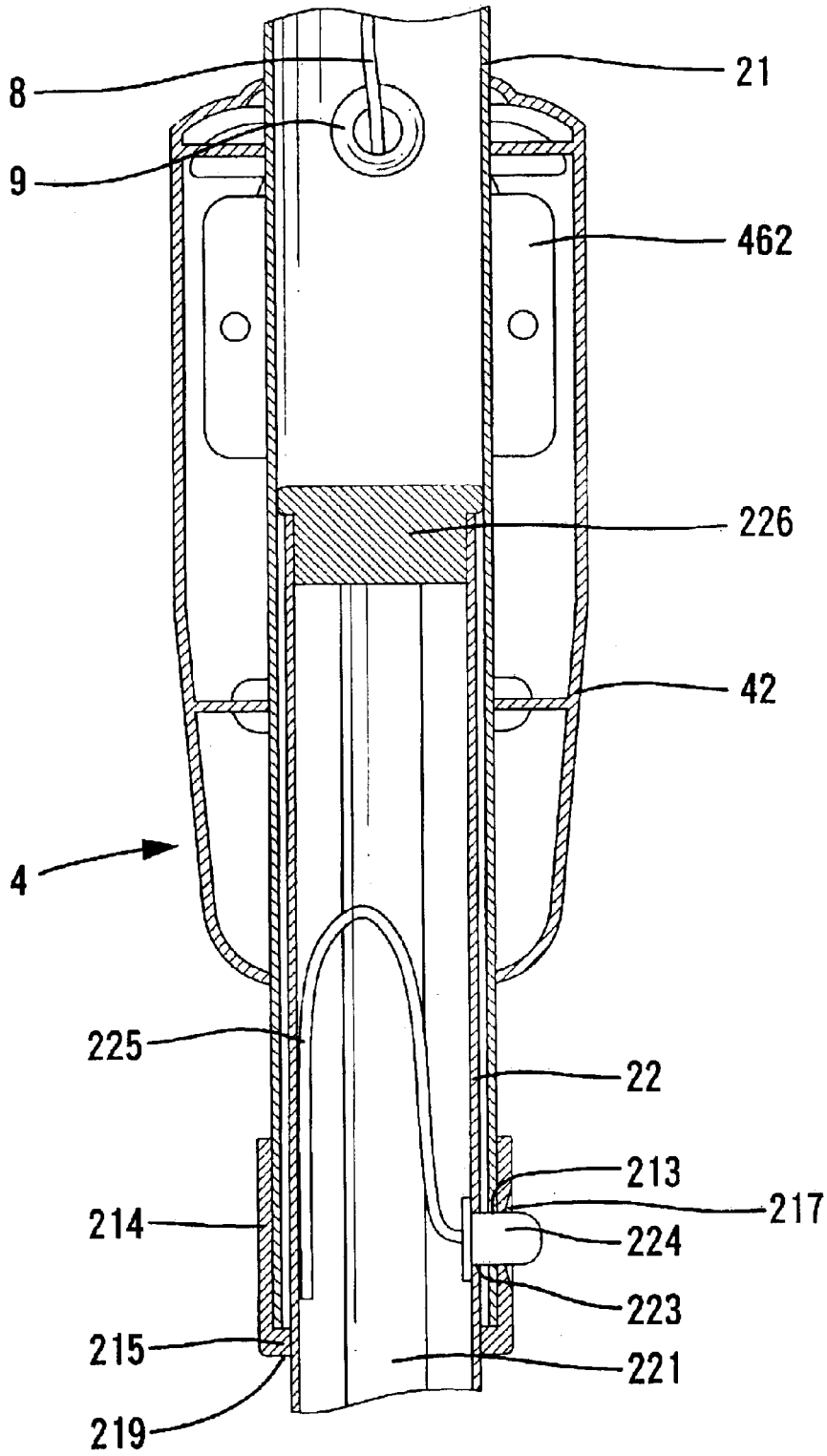
FIG. 6 is a sectional view taken along line 6—6 in FIG. 4.

As illustrated in FIGS. 5 and 6, a button 224 extends through the positioning hole 223 of the lower tube 22, the positioning hole 213 of the upper tube 21, and the transverse hole 217 of the lower cap 214. An end of an elastic element 225 is attached to an inner end of the button 224 and the other end of the elastic element 225 abuts against or securely attached to an inner periphery of the lower tube 22.

It is noted that the intermediate portion 446 of the shaft 44 around which the lower end of the cord 8 is wound is located outside the post 2 such that the upper tube 21 and the lower tube 22 can be telescopically moved relative to each other without interfering with the operation of the reel 4. Thus, when the shaft 44 of the handle 41 is turned, the cord 8 is moved in, e.g., the retracting direction and thus wound around the intermediate portion 446 of the shaft 44, thereby moving the stretchers 5 and the ribs 6 upward for unfolding the canopy 7 (see FIGS. 3, 4, 7, and 8). Alternatively, the shaft 44 of the handle 41 can be turned in the reverse direction to move the cord 8 in the releasing direction, thereby folding the canopy 7.

During unfolding operation of the canopy 7, the ratchet wheel 444 is also turned when the shaft 44 is turned. Reverse rotation of the ratchet wheel 44 is prevented by the catch 445 to prevent undesired rotation of the shaft 44 in the reverse direction under the action of the weight of the canopy 7, the ribs 6, and the stretchers 5. When the handle 41 is turned in the reverse direction for folding the canopy 7, the ratchet wheel 444 cannot be turned in the reverse direction, as the ratchet wheel 444 is securely engaged with the catch 445. Nevertheless, the user may apply a relatively large force greater than the clamping force of the washer 442 and the nut 443 to the ratchet wheel 444, forcing the shaft 44 to turn in the reverse direction for slowly folding the canopy 7 without the risk of sudden folding.

When folding of the post is required, the button 224 is pushed until an outer of the button 224 is moved into the upper tube 21. Next, the lower tube 22 can be retracted into the upper tube 21 (or the upper tube 21 can be moved toward the lower tube 22) to shorten the overall length of the post 2 without dismantling the upper and lower tubes 21 and 22. When use of the sunshade is required, the lower tube 22 is pulled out of the upper tube 22 until the button 224 reaches the positioning hole 213 of the upper tube 21 and the transverse hole 217 of the lower cap 214 and then springs out of the lower cap 214 to a position shown in FIG. 6 under the action of the elastic element 225. The outer end of the button 224 is preferably a dome to allow smooth sliding movement of the button 224 along the inner periphery of the upper tube 21. The stop 219 of the end wall 215 of the lower cap 214 prevents the lower tube 22 from being disengaged from the upper tube 21.

Figure 9:
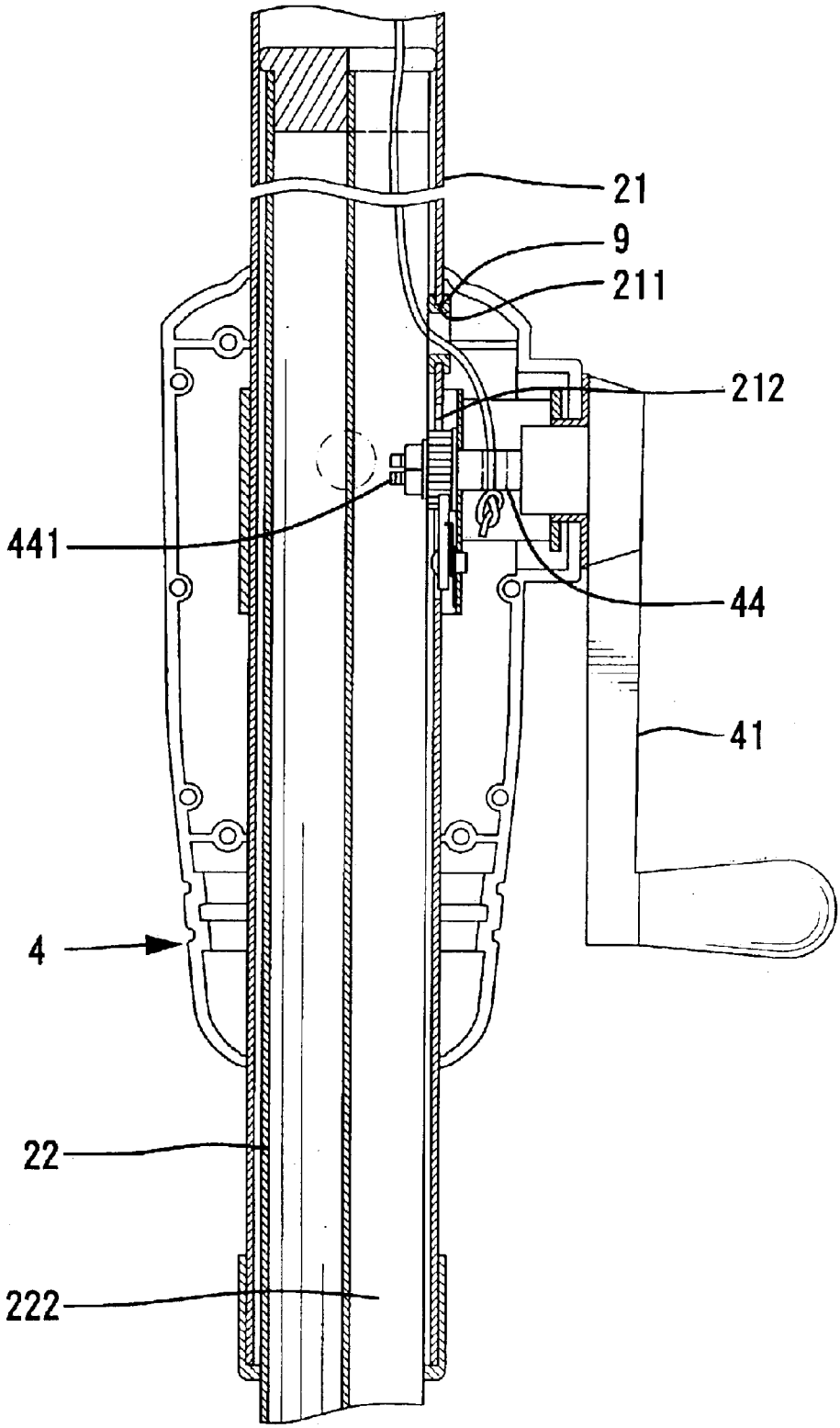
FIG. 9 is a view similar to FIG. 7, illustrating a modified embodiment of the sunshade in accordance with the present invention.

FIG. 9 illustrates a modified embodiment of the invention, wherein the upper tube 21 includes a hole 212 below the cord hole 211, allowing the inner end 441 of the shaft 44 to be extended into the longitudinal groove 222 of the lower tube 22 without interfering the relative telescopic movement between the upper tube 21 and the lower tube 22.

Although the invention has been explained in relation to its preferred embodiments, it is to be understood that many other possible modifications and variations can be made without departing from the scope of the invention as hereinafter claimed.

What is claimed is:

1. A sunshade comprising:

a post including an upper tube and a lower tube one of which is telescopically received in the other, one of the upper tube and the lower tube having a cord hole through which a lower end of a cord extends to an outside of the post; and a reel including a handle, a shaft being formed on an end of the handle, the shaft being rotatably supported by the post yet allowing relative telescopic movement between the upper tube and the lower tube, the shaft having a portion outside the post, with the lower end of the cord being attached to the portion of the shaft, the lower end of the cord being wound around the portion of the shaft when the cord is moved in a retracting direction, with the upper tube and the lower tube being selectively retained in an extended state and allowing the relative telescopic movement between the upper tube and the lower tube;

the lower tube being telescopically received in the upper tube;

the lower tube including a longitudinal groove in an outer periphery thereof, a portion of the cord being received in the longitudinal groove during the relative telescopic movement between the upper tube and the lower tube; and wherein the upper tube includes a lower cap attached to a lower end thereof, the lower cap including an end wall and a through hole extending through the end wall, a guide member projecting from an inner periphery of the lower cap and being guided in the longitudinal groove of the lower tube.

2. The sunshade as claimed in claim 1, wherein the lower end of the upper tube has a positioning hole, the lower tube having a positioning hole in an upper end thereof, the lower cap having a transverse hole aligned with the positioning hole of the upper tube, a button being extended through the transverse hole of the lower cap, the positioning hole of the upper tube, and the positioning hole of the lower tube, the button having an outer end and an inner end located in the lower tube, an elastic element having a first end attached to the inner end of the button and a second end abutting against an inner periphery of the lower tube, wherein the outer end of the button is normally biased by the elastic element to extend out of the post for securing the upper tube and the lower tube together, and wherein the relative telescopic movement between the upper tube and the lower tube is allowed when the outer end of the button is pushed into the upper tube.

3. The sunshade as claimed in claim 2, wherein the lower tube includes an upper cap attached to a top thereof, the upper cap having a longitudinal groove aligned with the longitudinal groove of the lower tube.

4. The sunshade as claimed in claim 2, wherein the end wall of the lower cap includes a stop to prevent the lower tube from being disengaged from the upper tube.

5. The sunshade as claimed in claim 1, wherein the cord hole is defined in the upper tube, with the sunshade further including a rubber ring inserted into the cord hole, the rubber ring having a hole through which the cord extends, preventing damage to the cord.

6. The sunshade as claimed in claim 5, further including a casing for housing the shaft of the handle.

7. The sunshade as claimed in claim 6, wherein the casing includes two casing halves that together form a through-hole through which the shaft extends.

8. The sunshade as claimed in claim 6, wherein the shaft of the handle is rotatably supported by a fixing seat, the fixing seat including two arcuate clamping plates on an end thereof to form a semi-circular clamping section for embracing a portion of a section of the upper tube, with the sunshade further including a semi-circular clamping plate securely connected to the semi-circular clamping section and embracing another portion of the section of the upper tube.

9. The sunshade as claimed in claim 1, further including a casing for housing the shaft of the handle.

10. The sunshade as claimed in claim 9, wherein the casing includes two casing halves that together form a through-hole through which the shaft extends.

11. A sunshade comprising:

a post including an upper tube and a lower tube one of which is telescopically received in the other, one of the upper tube and the lower tube having a cord hole through which a lower end of a cord extends to an outside of the post;

a reel including a handle, a shaft being formed on an end of the handle, the shaft being rotatably supported by the post yet allowing relative telescopic movement between the upper tube and the lower tube, the shaft having a portion outside the post, with the lower end of the cord being attached to the portion of the shaft, the lower end of the cord being wound around the portion of the shaft when the cord is moved in a retracting direction, with the upper tube and the lower tube being selectively retained in an extended state and allowing the relative telescopic movement between the upper tube and the lower tube; and wherein the shaft of the handle is rotatably supported by a fixing seat, the fixing seat including two arcuate clamping plates on an end thereof to form a semi-circular clamping section for embracing a portion of a section of the upper tube, with the sunshade further including a semi-circular clamping plate securely connected to the semi-circular clamping section and embracing another portion of the section of the upper tube.

12. The sunshade as claimed in claim 11, further including a casing for housing the shaft of the handle, wherein the casing includes a through-hole through which the shaft extends, with the sunshade further including an axle mounted around an outer portion of the shaft, a jacket being mounted around the axle and having a flange, the fixing seat including an outer wall distal to the upper tube and an inner wall that is closer to the upper tube than the outer wall, a periphery delimiting the through-hole of the casing being securely mounted between the outer wall and the flange of the jacket, the portion of the shaft around which the cord is wound being located between the inner wall and the axle.

13. The sunshade as claimed in claim 12, further including a ratchet wheel securely mounted on the shaft to turn therewith, a catch being mounted to the inner wall of the frame and meshing with the ratchet wheel, wherein during unfolding operation of the sunshade, the ratchet wheel is also turned when the shaft is turned, and the catch prevents reverse rotation of the ratchet wheel to thereby prevent undesired rotation of the shaft in a reverse direction.

14. The sunshade as claimed in claim 13, further including a washer and a nut mounted on the shaft, with the ratchet wheel being sandwiched between the washer and the nut, wherein when the handle is turned in the reverse direction for folding the sunshade when a relatively large force greater than a clamping force of the washer and the nut to the ratchet wheel is applied.

15. A sunshade comprising:

a post including an upper tube and a lower tube one of which is telescopically received in the other, one of the upper tube and the lower tube having a cord hole through which a lower end of a cord extends to an outside of the post; and a reel including a handle, a shaft being formed on an end of the handle, the shaft being rotably supported by the post yet allowing relative telescopic movement between the upper tube and the lower tube, the shaft having a portion outside the post, with the lower end of the cord being attached to the portion of the shaft, the lower end of the cord being wound around the portion of the shaft when the cord is moved in a retracting direction, with the upper tube and the lower tube being selectively retained in an extended state and allowing the relative telescopic movement between the upper tube and the lower tube;

the lower tube being telescopically received in the upper tube;

the lower tube including a longitudinal groove in an outer periphery thereof, a portion of the cord being received in the longitudinal groove during the relative telescopic movement between the upper tube and the lower tube; and wherein the upper tube includes a hole below the cord hole, the shaft having an inner end extending through the hole of the upper tube into the longitudinal groove of the lower tube without interfering with relative telescopic movement between the upper tube and the lower tube.

16. The sunshade as claimed in claim 15, wherein the upper tube includes a lower cap attached to a lower end thereof, the lower cap including an end wall and a through hole extending through the end wall, a guide member projecting from an inner periphery of the lower cap and being guided in the longitudinal groove of the lower tube.

17. The sunshade as claimed in claim 16, wherein the lower end of the upper tube has a positioning hole, the lower tube having a positioning hole in an upper end thereof, the lower cap having a transverse hole aligned with the positioning hole of the upper tube, a button being extended through the transverse hole of the lower cap, the positioning hole of the upper tube, and the positioning hole of the lower tube, the button having an outer end and an inner end located in the lower tube, an elastic element having a first end attached to the inner end of the button and a second end abutting against an inner periphery of the lower tube, wherein the outer end of the button is normally biased by the elastic element to extend out of the post for securing the upper tube and the lower tube together, and wherein the relative telescopic movement between the upper tube and the lower tube is allowed when the outer end of the button is pushed into the upper tube.

18. The sunshade as claimed in claim 17, wherein the lower tube includes an upper cap attached to a top thereof, the upper cap having a longitudinal groove aligned with the longitudinal groove of the lower tube.

19. The sunshade as claimed in claim 18, wherein the end wall of the lower cap includes a stop to prevent the lower tube from being disengaged from the upper tube.

20. The sunshade as claimed in claim 15, further including a casing for housing the shaft of the handle.

* * * * *